US005279716A

United States Patent [19]

Sharma

[11] Patent Number: 5,279,716

[45] Date of Patent: Jan. 18, 1994

[54] METHOD FOR PRODUCING MAGNESIUM METAL FROM MAGNESIUM OXIDE

[75] Inventor: Ram A. Sharma, Troy, Mich.

[73] Assignee: General Motors Corporation, Detroit, Mich.

[21] Appl. No.: 947,407

[22] Filed: Sep. 21, 1992

[51] Int. Cl.[5] ..... C25C 3/04

[52] U.S. Cl. ..... 204/70; 204/64 R

[58] Field of Search ..... 204/64 R, 70

[56] References Cited

U.S. PATENT DOCUMENTS

| | | | |
|---|---|---|---|
| 4,495,037 | 1/1985 | Ishizuka | 204/70 |
| 5,024,737 | 6/1991 | Claus et al. | 204/71 |
| 5,089,094 | 2/1992 | Ogasawara et al. | 204/70 |
| 5,118,396 | 6/1992 | Claus et al. | 204/64 R |

FOREIGN PATENT DOCUMENTS

| | | | |
|---|---|---|---|
| 2243789 | 9/1990 | Japan | C25C 3/004 |

*Primary Examiner*—John Niebling

*Assistant Examiner*—Patrick J. Igoe

*Attorney, Agent, or Firm*—George A. Grove

[57] ABSTRACT

A method is provided for the electrolytic production of magnesium metal. The method is highly economical in that the method permits the use of magnesium oxide as a feed stock for the electrolytic process. The method uses a rare earth chloride as a constituent of the electrolyte bath. The rare earth chloride spontaneously reacts with the magnesium oxide to form magnesium chloride. The magnesium chloride can then be electrolyzed using standard electrolysis methods. The avoidance of using magnesium chloride as the feed stock to the process eliminates the substantial costs involved with producing and purifying magnesium chloride from natural sources. In addition, the rare earth chloride continuously reacts with any magnesium oxide from any source which may form during the process to prevent a sludge from forming within the electrolyte, such that the process efficiently produces magnesium metal with no losses attributable to sludge formation.

10 Claims, No Drawings

METHOD FOR PRODUCING MAGNESIUM METAL FROM MAGNESIUM OXIDE

The present invention generally relates to the production of magnesium metal by an electrochemical reaction in an electrolytic bath. More particularly, this invention relates to an improved electrochemical process of this type, wherein the process is carried out in a molten salt flux which includes a magnesium compound, such as magnesium oxide, and a rare earth chloride, such that the magnesium compound and the rare earth chloride spontaneously react to form magnesium chloride, from which magnesium metal is produced during the electrolytic process.

BACKGROUND OF THE INVENTION

As a structural metal, magnesium is a highly attractive alternative to other structural metals, such as aluminum and steel, in both the aerospace and automotive industries. In particular, magnesium is light weight, has the highest strength-to-weight ratio of any structural metal, is machinable, and is dimensionally stable. However, an impediment to the widespread use of magnesium is that it is relatively expensive to produce.

It is known in the art to electrolytically produce magnesium metal through the use of a molten salt bath containing magnesium chloride ($MgCl_2$) and various other salts, such as calcium chloride ($CaCl_2$) and sodium chloride (NaCl). Conventionally, the magnesium chloride is electrolytically decomposed to produce magnesium metal (Mg) on a steel cathode and chlorine gas ($Cl_2$) on a graphite anode at temperatures between about 700° C. and about 740° C.

While the particular processes employed to produce magnesium metal vary within the relevant industry, a primary difference in the processes is the purity of the magnesium chloride used and the techniques employed for preparing the magnesium chloride. As an example, partially dehydrated magnesium chloride is used in one well known process, while anhydrous magnesium chloride is used in another. Natural resources of magnesium include seawater, salt lakes and underground brine and salt beds, as well as minerals such as magnesite ($MgCO_3$), dolomite ($CaMg(CO_3)_2$), carnallite ($KCl.MgCl_2.6HOH$ or $KMgCl_3.6HOH$) and brucite ($Mg(OH)_2$), each of which requires different processing procedures to procure substantially pure magnesium chloride.

While the purity or source of the magnesium chloride may differ, it is the preparation of the magnesium chloride feed stock which forms the economic burden to the electrolytic process. The U.S. Department of Energy, Final Report EX-76-A-01-2295 (1981), entitled "An Assessment of Magnesium Primary Production Technology", M.C. Flemings et al., reported that about fifty percent of the total cost and energy consumption for the production of magnesium is consumed in the preparation of the magnesium chloride. The high cost of using "pure" magnesium chloride as a feed stock is substantially a result of the numerous processing steps necessary for its preparation, which include, depending on the method adopted, precipitation, filtration and calcination, pelletization, chlorination, and alternatively neutralization and dehydration processes. Accordingly, a significant economic impediment to the production and use of magnesium would be removed if the process did not rely on the use of magnesium chloride as the feed stock.

In the preparation of magnesium chloride, magnesium oxide (MgO) is a common impurity that is highly undesirable in the electrolyte bath. Because magnesium oxide is only slightly soluble in the conventional electrolytes known in the art, it remains suspended throughout the process, causing a sludge to form within the electrolyte. As a result, some elemental magnesium is lost during the process as sludge, which must be periodically removed from the electrolytic cell.

Even if magnesium oxide is substantially removed as an impurity by the manner in which magnesium chloride is conventionally refined, the undesirable sludge still forms because magnesium chloride reacts with the water and/or moisture present in the other constituents of the electrolyte bath to form magnesium oxide. Accordingly, the formation of sludge is likely to occur regardless of the purity of the magnesium chloride used as the feed stock to the electrolytic process.

From the above, it is readily apparent that presently known electrolytic methods for producing magnesium metal entail an involved process for procuring and purifying magnesium chloride from natural sources. Furthermore, a primary impurity, magnesium oxide, is highly undesirable within known electrolytic processes in that it results in the loss of some elemental magnesium through the formation of a sludge. Finally, this sludge has a tendency to form even when highly pure magnesium chloride is used as the feed stock to the process because of the ability for magnesium oxide to form by the reaction of magnesium chloride with water and/or moisture present in the other constituents of the electrolyte bath.

Thus, it would be desirable to provide a more economical method for producing magnesium metal which does not require pure magnesium chloride as the feed stock for the electrolysis process, and prevents the formation of suspended magnesium oxide in the electrolyte during the electrolysis process.

SUMMARY OF THE INVENTION

It is an object of this invention to provide a method for electrolytically producing magnesium metal, wherein the method is both economical and practical in terms of the number and cost of the required processing steps.

It is a further object of this invention that such a method permit the use of magnesium oxide or magnesium chloride contaminated with magnesium oxide as the feed stock for the electrolytic process.

It is another object of this invention that such a method prevent the formation of a magnesium oxide sludge within the electrolyte bath, regardless of whether the feed stock used is magnesium chloride or magnesium oxide.

Lastly, it is still another object of this invention that such a method be able to utilize substantially conventional equipment within which the electrolytic process is carried out.

In accordance with a preferred embodiment of this invention, these and other objects and advantages are accomplished as follows.

According to the present invention, there is provided a method for producing magnesium metal in which magnesium compounds, and more particularly, magnesium oxide can be used as the feed stock for an electrolytic process. As another primary aspect of this invention, the method eliminates the presence of magnesium oxide in the electrolyte so as to prevent the formation of a magnesium oxide sludge within the electrolyte. This aspect is beneficial whether the feed stock is magnesium oxide or substantially pure magnesium chloride conventionally prepared in accordance with the prior art.

To permit the direct use of magnesium oxide as a feed stock while simultaneously preventing the presence of magnesium oxide in the electrolyte, the method includes the use of a rare earth chloride, such as neodymium chloride ($NdCl_3$), as a constituent to the electrolyte. Using neodymium chloride as an example, the neodymium chloride reacts with magnesium oxide, whether originally introduced as the feed stock or formed from the reaction between water or moisture and magnesium chloride, according to the reaction:

$$NdCl_3 + MgO \rightarrow NdOCl + MgCl_2 \quad (1)$$

The above reaction tends to be spontaneous in that it has a negative free energy change at the relevant operating temperatures. The amount of rare earth chloride required to eliminate the magnesium oxide in the electrolyte will vary with the feed stock used. Accordingly, the rare earth chloride must constitute significantly more of the electrolyte solution when magnesium oxide is the feed stock than when substantially pure magnesium chloride serves as the feed stock in a conventional electrolytic process.

As a result of the reaction illustrated in Reaction (1), magnesium oxide used as feed stock will immediately form magnesium chloride once in the electrolyte. Alternatively, when magnesium chloride is used as the feed stock according to conventional practices, any magnesium oxide which may subsequently form within the electrolyte from a reaction between the feed stock magnesium chloride and moisture, will immediately react with the rare earth chloride to reform magnesium chloride. Therefore, magnesium oxide is eliminated as a solid from the electrolyte and prevented from forming the undesirable sludge noted with the prior art. As a result, substantially all of the magnesium chloride is available to be electrolyzed to form magnesium metal in a conventional manner.

Following the spontaneous chemical reaction described in Reaction (1), the electrolysis of the magnesium chloride can be carried out at substantially conventional temperatures using a conventional carbon-based anode and an iron-based cathode. A suitable electrical potential is imposed across the cathode and anode to electrochemically form magnesium metal at the cathode and chlorine gas at the anode according to the reaction:

$$MgCl_2 \rightarrow Mg + Cl_2 \quad (2)$$

The magnesium metal separates as a liquid and, because it is lower in density than the electrolyte, floats on top of the electrolyte.

The byproduct of the chemical reaction, a rare earth oxychloride, neodymium oxychloride (NdOCl) in the present example, is soluble to some extent in the electrolyte at the temperatures necessary for the electrolysis of magnesium metal. In addition, the neodymium oxychloride is presumably destroyed electrolytically, producing carbon monoxide (CO) and carbon dioxide ($CO_2$) on the carbon-based anode, while simultaneously regenerating the neodymium chloride. Each of these reactions has a negative standard free energy change, such that the neodymium oxychloride spontaneously reacts with carbon (provided by the carbon-based anode) and the chlorine gas (formed in accordance with Reaction (2)) to reform the rare earth chloride.

The method of this invention is substantially more economical than that of the prior art in that there is no requirement for the costly and time consuming processes of preparing the magnesium chloride feed stock. As a result, the costs associated with the processes utilized by the prior art are avoided. Both magnesium oxide and magnesium chloride containing a magnesium oxide impurity can be easily obtained by any conventional method.

In that any and all magnesium oxide introduced or formed in the electrolyte bath will be consumed by the rare earth chloride, no sludge formation will occur as long as a sufficient quantity of the rare earth chloride is present in the bath. As a result, the method of this invention is more efficient than that of the prior art because no elemental magnesium is lost as a sludge during production.

Other objects and advantages of this invention will be better appreciated from the following detailed description.

DETAILED DESCRIPTION OF THE INVENTION

A method is provided for the electrolytic production of magnesium metal in accordance with this invention. The method of this invention is highly economical in that it allows for the direct use of a feed stock containing or consisting of magnesium oxide for the electrolytic process. The method uses a rare earth chloride as a constituent of the electrolyte bath, through which a spontaneous reaction occurs with the magnesium oxide to form magnesium chloride. The magnesium chloride can then presumably be electrolyzed by standard methods. In addition, the rare earth chloride continuously reacts with any magnesium oxide which may form during the electrolytic process to prevent a sludge from forming within the electrolyte, such that the process efficiently produces magnesium metal with substantially no losses attributable to sludge formation.

From the above, it is apparent that any combination of magnesium oxide and magnesium chloride can be used as feed stock for the preferred electrolytic process of this invention. At the extremes, either magnesium chloride or magnesium oxide can be used as the feed stock for the process. Where magnesium chloride is prepared as the feed stock, as in the case for a conventional electrolytic production method, the rare earth chloride serves to eliminate the presence of magnesium oxide in the electrolyte as a result of the magnesium chloride reacting with the water or moisture in the electrolyte. Alternatively, the rare earth chloride is essential if magnesium oxide is used as the feed stock, in that the magnesium oxide must first be reacted to form magnesium chloride before magnesium production by electrolysis can occur.

Both magnesium oxide and magnesium chloride feed stocks can be readily produced by any conventional method. Such operations are well known in the art, and will not be discussed further. Typically, such conventional operations will produce a feed stock of either magnesium chloride or magnesium oxide, with minor impurities. Where magnesium chloride is preferred as the feed stock, further processing is necessary to eliminate the magnesium oxide. However, in accordance with this invention, the product of such an operation can be used directly as feed stock in that the magnesium oxide will be converted to magnesium chloride by reacting with the rare earth chloride.

In addition to the above feed stock formulations, magnesium carbonate can also be used directly as the feed stock. Magnesium carbonate can be used directly in that magnesium carbonate decomposes to form magnesium oxide and carbon dioxide according to the reaction:

$$MgCO_3 \rightarrow MgO + CO_2 \quad (3)$$

The decomposition of magnesium carbonate occurs at temperatures which are less than that required for the electrolysis of magnesium chloride. Therefore, the use of magnesium carbonate as a feed stock is essentially tantamount to using magnesium oxide. Accordingly, the operating parameters of this invention will result in the conversion of a magnesite feed stock to magnesium oxide, which will then react with the rare earth chloride to form the magnesium chloride necessary for the primary electrolytic process by which magnesium metal is produced.

According to this invention, the composition of the electrolyte bath is determined by the composition of the feed stock used. The composition of the electrolyte will vary in terms of the amount of the rare earth chloride in the bath. The representative rare earth chloride is neodymium chloride. However, any of the rare earth chlorides can be used in its place due to their similar behavior. Within the electrolyte bath, the neodymium chloride reacts with the magnesium oxide to form neodymium oxychloride and magnesium chloride according to Reaction (1):

$$NdCl_3 + MgO \rightarrow NdOCl + MgCl_2 \quad (1)$$

The above reaction tends to be spontaneous in that it has a negative free energy change at all temperatures. The value of standard free energy change for this reaction is calculated from the respective free energy data of the compounds to be about −5 kilocalories at about 727° C., and has been reported to be about −700° calories at about 800° C. and about −400 calories at about 900° C. from differential thermal analysis measurements.

For purposes of practicing this invention, it is necessary that the neodymium chloride be provided in sufficient quantities such that substantially all of the magnesium oxide is converted to magnesium chloride in the electrolyte bath. In a first embodiment, for example, about 5 to about 10 weight percent neodymium chloride may be used in a conventional electrolyte known in the prior art. This amount can be adjusted based upon chemical analysis of magnesium chloride according to Reaction (1), or by trial and error, and foreseeably may vary from a very small amount, such as almost zero weight percent, to a very large amount, such as almost 100 weight percent, depending on the constituents of the feed stock. Accordingly, a suitable electrolyte would consist of a molten salt bath containing magnesium chloride as the feed stock and various other salts, such as calcium chloride and sodium chloride. Known electrolyte formulations include between about 10 and about 25 weight percent magnesium chloride, up to about 60 weight percent sodium chloride, up to about 50 weight percent calcium chloride, up to about 10 weight percent potassium chloride, and up to about 1 weight percent calcium fluoride.

In accordance with this invention, as low as almost 1 weight percent, and more preferably about 5 to about 10 weight percent neodymium chloride may be added to this electrolyte to eliminate the formation of a magnesium oxide sludge in the electrolyte.

However, the amount of neodymium chloride necessary to practice this invention will increase as the quantity of magnesium oxide in the feed stock increases. As a particular example, and one which is described in terms of a second embodiment below, much higher quantities of neodymium chloride are used when the feed stock consists entirely of magnesium oxide. One skilled in the art will be able to analytically determine the amount of rare earth chloride necessary for particular application without undue experimentation.

An electrolyte in accordance with the second embodiment of this invention consists essentially of a completely molten solution of neodymium oxychloride and magnesium chloride. This solution is derived by introducing a quantity of magnesium oxide and/or magnesium carbonate as feed stock into an electrolyte cell containing neodymium chloride, and additions of magnesium chloride if desired. If necessary for a particular application, additions of magnesium fluoride ($MgF_2$), lithium chloride (LiCl), and other known salts may be added.

In that this embodiment of the invention employs neodymium chloride and magnesium chloride without the use of conventional electrolyte constituents, the preferred quantity of neodymium chloride will be much higher than suggested for use with a conventional molten salt bath of calcium chloride and sodium chloride. As an example, an electrolyte composition containing more than about 75 weight percent neodymium chloride, with the remainder being essentially magnesium chloride, is entirely foreseeable in the practice of this invention.

The equilibrium phase diagram of the magnesium chloride-neodymium oxychloride system indicates about 36 mole percent neodymium oxychloride is soluble in magnesium chloride at about 640° C. Furthermore, the magnesium chloride-neodymium chloride-neodymium oxychloride ternary portion of the magnesium chloride-neodymium chloride-neodymium oxychloride-magnesium oxide system indicates a ternary eutectic at about 620° C. and a large region of melts below about 750° C. In other words, a large number of melts are available for use as electrolytes if needed.

Once an electrolyte bath is formulated, the bath is held at a temperature of at least about 620° C. (corresponding to the above eutectic temperature) to ensure the melting of all constituents. More preferably, the temperature is held at about 700° C. to about 750° C. These temperatures are also above the melting point for magnesium metal, which melts at about 651° C. At such temperatures, the constituents will melt and react to form magnesium chloride and neodymium oxychloride, with some neodymium chloride remaining in solution. However, the magnesium oxide will not be present as a result of its complete reaction with the neodymium chloride in accordance with Reaction (1).

With the spontaneous chemical reaction between magnesium oxide and neodymium chloride, the electrolysis of the resulting magnesium chloride can presumably be carried out at substantially conventional temperatures using a conventional carbon-based anode and an iron-based cathode, as will be more fully described below. With suitable electrical potential imposed across the cathode and anode, magnesium metal is electrochemically formed at the cathode according to Reaction (2):

$$MgCl_2 \rightarrow Mg + Cl_2 \quad (2)$$

From the reaction described above, it can be seen that the magnesium chloride is electrolyzed to form magnesium metal in a substantially conventional manner. Furthermore, a sufficient quantity of neodymium chloride in the electrolyte assures that magnesium oxide solids will not be present in the electrolyte to form a sludge within the electrolyte.

Because magnesium oxide has a standard free energy change which is nearly that of magnesium chloride, ionic magnesium oxide in the electrolyte solution can be electrolyzed to form magnesium metal and oxygen. From this reaction, molten magnesium metal will form at the cathode of the electrolyte cell, releasing elemental oxygen which is free to react with the carbon-based anode to form carbon monoxide (CO). As a result, essentially all of the magnesium oxide will either be reacted with the neodymium chloride or presumed otherwise to be ionic in the electrolyte so as to be capable of being electrolyzed directly to form magnesium metal.

As previously indicated, a byproduct of the magnesium oxide-neodymium chloride reaction is neodymium oxychloride (NdOCl). As stated above, about 36 mole percent neodymium oxychloride is soluble in magnesium chloride at about 640° C. Furthermore, neodymium oxychloride is soluble in the neodymium chloride/-magnesium chloride electrolyte at about 725° C., as observed from the ternary phase diagram. In addition, neodymium oxychloride will presumably react during electrolysis according to Reactions (4) and (5):

$$NdOCl + C + Cl_2 \rightarrow NdCl_3 + CO \quad (4)$$

and $$2NdOCl + C + 2Cl_2 \rightarrow 2NdCl_3 + CO_2 \quad (5)$$

Each reaction has a negative standard free energy change, such that the neodymium oxychloride will spontaneously react with the carbon-based anode and the chlorine gas generated during the electrolysis process to reform the neodymium chloride. This continuous regeneration of the neodymium chloride enables the electrolysis process to be continuous as long as further additions of magnesium oxide are introduced into the electrolyte.

In addition, this feature permits the initial formulation of the electrolyte to be magnesium chloride and neodymium oxycholoride in sufficient amounts, such that once the magnesium metal forms at the cathode, the neodymium oxychloride is free to react with the carbon-based anode and the chlorine gas to form neodymium chloride for a subsequent electrolysis process.

The electrolysis process can be carried out in a conventional electrolyte cell formed by a large gas-fired iron pot set in a brick enclosure. The electrolyte cell preferably includes graphite anodes which are immersed in the electrolyte and mild steel plates which surround the anodes and serve as the cathode for the process. The electrolyte cell is then filled with an electrolyte solution formulated in accordance with this invention. With the electrolyte preferably held at temperatures of about 700° C. to about 750° C., a suitable quantity of magnesium oxide or magnesium chloride feed stock is introduced into the cell. If magnesium oxide is used as feed stock, immediately all of the magnesium oxide will react with the neodymium chloride to form magnesium chloride and neodymium oxychloride. Otherwise, the neodymium chloride will react with any magnesium oxide formed as a result of the magnesium chloride reacting with the water or moisture within the electrolyte bath.

A suitable electrical potential, minimally at a value greater than the electrochemical decomposition potential of magnesium chloride (about 2.6 volts), is imposed across the anode and cathode to create a current which passes through the electrolyte. As a result, the magnesium chloride is presumably electrolyzed to form magnesium metal at the cathode and chlorine gas at the graphite anode. The neodymium oxychloride is simultaneously converted back to neodymium chloride by reacting with graphite anode and the chlorine gas according to Reactions (4) and (5). As a result, carbon monoxide and carbon dioxide also form on the graphite anodes. The carbon monoxide and carbon dioxide bubble to the top of the electrolyte bath, where they collect and are exhausted from the electrolyte cell.

The magnesium metal forms on the cathode plates and, because the electrolyte bath is preferably held above the melting temperature of magnesium metal, the reduced metal collects as a liquid film. In addition, because the magnesium metal is less dense than the electrolyte bath, the magnesium metal rises to the surface of the bath where it can be removed using conventional devices, such as a ladle. The time between the introduction of the feed stock and the removal of the magnesium metal will vary with the quantities involved. At the end of the electrolysis process, the electrolyte contains neodymium chloride which is suitable for reuse in a subsequent electrolysis.

A significant advantage of this invention is that the method employed to produce magnesium metal is substantially more economical than that of the prior art. Primarily, there is no requirement for the costly and time consuming processes involved in preparing a suitable pure magnesium chloride feed stock, though the use of magnesium chloride as the feed stock is entirely within the scope of this invention in accordance with the first embodiment. However, in place of magnesium chloride, the method of this invention is capable of using magnesium oxide as the feed stock for the electrolytic process, in accordance with the second embodiment. It is then apparent that a feed stock can be used that is formulated anywhere between these two extremes, such that the feed stock may consist of magnesium chloride with magnesium oxide as an impurity.

Another significant advantage of this invention is that all magnesium oxide introduced or formed in the electrolyte bath is either consumed by the rare earth chloride to form magnesium chloride, which is soluble in the electrolyte bath. As such, no magnesium oxide solids are available to form a sludge within the electrolyte as long as a sufficient quantity of rare earth chloride is present in the bath. As a result, the method of this invention is highly efficient in that substantially no elemental magnesium is lost as a sludge during production of the magnesium metal.

In addition, the method of this invention utilizes a substantially regenerating electrolyte bath, with the rare earth chloride being reformed during the electrolysis of the magnesium chloride.

It is foreseeable that the magnesium oxide-neodymium chloride reaction utilized with this invention could be beneficial in other processing situations where magnesium oxide is formed and constitutes a problems due to its insolubility in other salt or metal phases.

Therefore, while my invention has been described in terms of a preferred embodiment, it is apparent that other forms could be adopted by one skilled in the art; for example, by modifying the processing parameters such as the temperatures or durations employed, or by substituting or adding appropriate salts to the electrolyte bath, or by utilizing the magnesium oxide-neodymium chloride reaction in an alternative process. Accordingly, the scope of my invention is to be limited only by the following claims.

The embodiments of the invention in which an exclusive property or privilege is claimed are defined as follows:

1. A method for producing magnesium metal comprising the steps of:

forming a molten salt electrolyte solution comprising rare earth metal cations, magnesium cations and chloride anions;

adding a magnesium compound to the molten salt electrolyte solution, said magnesium compound being selected from the group consisting of magnesium chloride, magnesium oxide and mixtures thereof, the rare earth metal cations being present in a sufficient amount to react with any magnesium oxide in the molten salt electrolyte solution to form magnesium cations therefrom; and electrolytically reducing magnesium cations to produce molten magnesium metal;

whereby the reaction between the magnesium oxide and the rare earth cations substantially prevents the formation of a magnesium oxide sludge in the molten salt electrolyte solution.

2. A method for producing magnesium metal as recited in claim 1 wherein the rare earth cations comprise neodymium cations.

3. A method for producing magnesium metal as recited in claim 1 wherein said step of electrolytically reducing the magnesium cations utilizes a carbon-based anode and an iron-based cathode, and wherein the magnesium metal forms at the iron-based cathode.

4. A method for producing magnesium metal comprising the steps of:

forming a molten salt electrolyte solution comprising rare earth metal cations, magnesium cations and chloride anions;

adding to the molten salt electrolyte solution a feed stock consisting essentially of magnesium oxide, the rare earth metal cations being present in a sufficient amount to react with the magnesium oxide to form magnesium cations and oxychloride anions; and electrolytically reducing the magnesium cations to produce molten magnesium metal and concomitantly reducing at least a portion of the oxychloride anions so as to continuously regenerate chloride anions;

whereby the reaction between the magnesium oxide and the rare earth cations substantially prevents the formation of a magnesium oxide sludge within the molten salt electrolyte solution and whereby the continuous regeneration of the chloride anions in the molten salt electrolyte solution enables magnesium metal to be substantially continuously produced upon further additions of magnesium oxide to the molten salt electrolyte solution.

5. A method for producing magnesium metal as recited in claim 4 wherein the rare earth cations are present in an amount of at least about 1 weight percent of the molten salt electrolyte solution.

6. A method for producing magnesium metal as recited in claim 4 wherein the rare earth cations comprise neodymium cations.

7. A method for producing magnesium metal as recited in claim 4 wherein the step of electrolytically reducing magnesium cations utilizes a carbon-based anode and an iron-based cathode, and wherein magnesium metal forms at the iron-based cathode and chloride gas forms at the carbon-based anode.

8. A method for producing magnesium metal as recited in claim 4 wherein the molten salt electrolyte solution is maintained at a temperature of about 700° C. to about 750° C. during the step of electrolytically reducing magnesium cations.

9. A method for producing magnesium metal as recited in claim 1 wherein the molten salt electrolyte solution also comprises fluoride anions.

10. A method for producing magnesium metal as recited in claim 4 wherein the molten salt electrolyte solution also comprises fluoride anions.

* * * * *